US007469118B2

(12) United States Patent
Inaba

(10) Patent No.: US 7,469,118 B2
(45) Date of Patent: Dec. 23, 2008

(54) IMAGE FORMING APPARATUS WITH POSITION CHANGING DEVELOPING DEVICES

(75) Inventor: Michio Inaba, Nagoya (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 90 days.

(21) Appl. No.: 11/508,887

(22) Filed: Aug. 24, 2006

(65) Prior Publication Data

US 2007/0048022 A1 Mar. 1, 2007

(30) Foreign Application Priority Data

Aug. 26, 2005 (JP) ..... 2005-246122

(51) Int. Cl.
*G03G 15/01* (2006.01)

(52) U.S. Cl. ..... 399/228

(58) Field of Classification Search ..... 399/54, 399/223, 228, 299

See application file for complete search history.

(56) References Cited

U.S. PATENT DOCUMENTS

| | | | | |
|---|---|---|---|---|
| 6,546,218 | B2 * | 4/2003 | Uchida | 399/228 X |
| 6,681,088 | B2 * | 1/2004 | Kanno et al. | 399/228 X |
| 6,795,671 | B2 * | 9/2004 | Matsuoka | 399/223 |
| 6,819,350 | B2 | 11/2004 | Yokoi | |
| 2003/0058328 | A1 | 3/2003 | Yokoi | |
| 2004/0136742 | A1 * | 7/2004 | Saito et al. | 399/228 X |

FOREIGN PATENT DOCUMENTS

| | | |
|---|---|---|
| JP | 06-236116 | 8/1994 |
| JP | 10-319331 | 12/1998 |
| JP | 2001-125457 | 5/2001 |
| JP | 2002-351182 | 12/2002 |
| JP | 2003-98934 | 4/2003 |
| JP | 2004-20855 | 1/2004 |
| JP | 2004-21177 | 1/2004 |
| JP | 2005-37456 | 2/2005 |

OTHER PUBLICATIONS

Japanese Office Action, with English translation, issued in Japanese Patent Application No. JP 2005-246122, dated Oct. 16, 2008.

* cited by examiner

*Primary Examiner*—Sandra L Brase
(74) *Attorney, Agent, or Firm*—McDermott Will & Emery LLP

(57) ABSTRACT

An image forming apparatus that inhibits malfunctions therein via control such that respective developing devices change positions at predetermined timings. In a color laser printer, a first position is a position on a photosensitive drum facing a developing roller established when a developing roller moves to a developing position. A second position is a position on a photosensitive drum facing another developing roller when the developing roller moves to a developing position. First and second corresponding portions are portions on the conveying belt respectively corresponding to the first and second positions. The timing for moving the first developing roller and the second developing roller is controlled via a control apparatus and actuator such that a distance between the first corresponding portion and the second corresponding portion is less than a reference distance determined when the first developing roller and the second developing roller simultaneously approach the photosensitive drum.

19 Claims, 13 Drawing Sheets

IMAGE FORMING APPARATUS WITH POSITION CHANGING DEVELOPING DEVICES

CROSS REFERENCE TO RELATED APPLICATIONS

This application claims priority from Japanese Patent Application No. 2005-246122 filed on Aug. 26, 2005. The entire content of this priority application is incorporated herein by reference.

TECHNICAL FIELD

This disclosure relates to an image forming apparatus.

BACKGROUND

Conventionally, in the field of image forming apparatuses such as laser printers, a configuration has been proposed in which the positions of a plurality of developing apparatuses are changed between a withdrawn position and a developing position. For example, according to the technology disclosed in Japanese Laid Open Patent No. 2004-20855, the positions of a plurality of developing apparatuses can be changed on the basis of the driving force of a single drive motor. In addition, the number of developing apparatuses that are driven by a single position changing operation can be decreased by staggering the timing for changing the positions of at least one of the developing apparatuses with respect to the timing for changing the positions of other developing apparatuses. According to this technology, developing apparatuses can be smoothly driven even with a low torque drive motor.

SUMMARY

However, in an image forming apparatus including a plurality of developing apparatuses as described above there is a concern that the movement of each of the developing devices approaching a photosensitive member can exert a negative influence on a common image bearing member. For example, a situation may occur in which developer adheres to a photosensitive member due to an impact or the like caused when a developing apparatus moves to a developing position. As a result, unwanted developer (i.e., developer that is unrelated to normal image formation) from the developing apparatuses may adhere to the common image bearing member. Therefore, appropriate measures (e.g., cleaning of the relevant position by a cleaning device) must be taken.

When there is a negative effect on the common image bearing member due to the movement of each developing device approaching a photosensitive member in this manner, it can be considered that the range of the effect (e.g., unwanted developer) thereof is based on the timing of the changing of the positions of the developing apparatuses. There is a concern that without taking some form of action, or by merely staggering the timing, the negative effect will not be controlled and the problem will not be effectively dealt with.

Accordingly, in view of the foregoing, there is a need for timing control of the developing devices that can control and prevent problems in an image forming apparatus as much as possible.

This invention was made in view of the above circumstances. At least some aspects of the present invention relate to providing a configuration that can effectively control and prevent problems occurring in an image forming apparatus by controlling positional changes of each developing device at a predetermined timing.

One aspect of an image forming apparatus comprises a plurality of photosensitive members. The plurality of photosensitive members may include a first photosensitive member and a second photosensitive member. In addition, the image forming apparatus comprises a plurality of developing devices corresponding to the photosensitive members. Each of the plurality of developing devices is disposed at a perimeter of a corresponding photosensitive member. Also, the plurality of developing devices comprises a first developing device and a second developing device.

The image forming apparatus may include a plurality of position changing devices corresponding to the plurality of developing devices. Each of the plurality of position changing devices causes a corresponding developing device to change positions between a developing position, adjacent to the photosensitive member, and a separated position apart from the photosensitive member.

In addition, developer from each of the plurality of developing devices may be transferable to a common image bearing member opposing the plurality of photosensitive members.

A first position is established when a position on the first photosensitive member opposes the first developing device at a point in time when the first developing device has changed to the developing position. Similarly, a second position established when a position on the second photosensitive member opposes the second developing device at a point in time when the second developing device has changed to the developing position.

A first corresponding portion on the common image bearing member is established when a portion of the common image bearing member opposes the first position. Additionally, a second corresponding portion on the common image bearing member is established when a portion of the common image bearing member opposes the second position.

The image forming apparatus further includes a control device for controlling the timing of the plurality of position changing devices. The timing for changing a position of the first developing device and a position of the second developing device is provided such that a distance between the first corresponding portion and the second corresponding portion is less than a reference distance between the first corresponding portion and the second corresponding portion. The reference distance is established when the first developing device and the second developing device simultaneously change to the developing positions.

According to the configuration set forth in this aspect, since it is possible to narrow the distance between the first corresponding portion and the second corresponding portion, measures can be effectively carried out to resolve the effects of the developing device approach movements upon the common image bearing member.

The image forming apparatus according to another aspect may further include a cleaning device comprising a contact component configured to contact and separate from the common image bearing member. The control device controls the contact timing of the contact component.

In a still further aspect, the image forming apparatus is configured so that the first developing device is disposed further upstream with respect to a sheet conveying direction than the second developing device. The control device may control the first position changing device and the second position changing device so that the first corresponding portion is further upstream on the common image bearing member than the second corresponding portion.

Another aspect of the image forming apparatus includes at least one other developing device among the plurality of developing devices. A third position is established when a position on a corresponding one of the plurality of photosensitive members opposes one of the at least one other developing devices when the one of the at least one other developing devices changes position to a developing position. A third corresponding portion is established when a portion on the common image bearing member corresponds to the third position.

The control device controls the plurality of position changing devices so that the first corresponding portion, the second corresponding portion, and the third corresponding portion are at the same position on the common image bearing member.

Still another aspect of the image forming apparatus comprises a photosensitive member and a plurality of developing devices. The plurality of developing devices is disposed at a perimeter of the photosensitive member. In addition, the plurality of developing devices comprises a first developing device and a second developing device.

The image forming apparatus further comprises a plurality of position changing devices corresponding to the plurality of developing devices. Each of the plurality of position changing devices causes a corresponding developing device to change positions between a developing position, adjacent to the photosensitive member, and a separated position apart from the photosensitive member.

Developer from each of the plurality of developing devices is transferable to a common image bearing member comprising the photosensitive member.

A first position is established when a position on the photosensitive member opposes the first developing device at the point in time when the first developing device has changed to a developing position. A second position is established when a position on the photosensitive member opposes the second developing device when the second developing device has changed to a developing position.

A first corresponding portion on the common image bearing member corresponds to the first position. A second corresponding portion on the common image bearing member corresponds to the second position.

The image forming apparatus also comprises a control device for controlling the timing of the plurality of position changing devices. The timing for changing the position of the first developing device and the position of the second developing device is provided such that a distance between the first corresponding portion and the second corresponding portion is less than a reference distance between the first corresponding portion and the second corresponding portion. The reference distance is established when the first developing device and the second developing device simultaneously change to developing positions.

Another further aspect of the image forming apparatus is configured such that the plurality of developing devices comprises at least one other developing device. In addition, the first developing device is disposed furthest upstream relative to a sheet conveying direction from among the plurality of developing devices.

A third position is established when a position on the photosensitive members opposes one of the at least one other developing devices when the one of the at least one other developing devices changes position to a developing position. A third corresponding portion on the common image bearing member is established that corresponds to the third position. The control device controls the plurality of position changing devices such that the second corresponding portion and the third corresponding portion are at the same position, downstream of the first corresponding portion, on the common image bearing member.

According to the configuration set forth in this aspect, even when there is a deviation in the positions of the second corresponding portion and the third corresponding portion, it is difficult for a situation to arise in which the second corresponding portion and third corresponding portion are positioned further upstream than the first corresponding portion. It is therefore possible to effectively prevent a negative effect from spreading to the upstream side of the first corresponding portion. Accordingly, it is possible to further narrow an area that is affected by the movements of the developing devices approaching the photosensitive member. In addition, it is possible to also prevent a situation in which there is an increased time required for preparation of image formation.

BRIEF DESCRIPTION OF THE DRAWINGS

Illustrative aspects in accordance with the invention will be described in detail with reference to the following figures, wherein.

DETAILED DESCRIPTION

An illustrative aspect of this invention will now be described with reference to the drawings.

1. Overall Configuration

Figure 1:
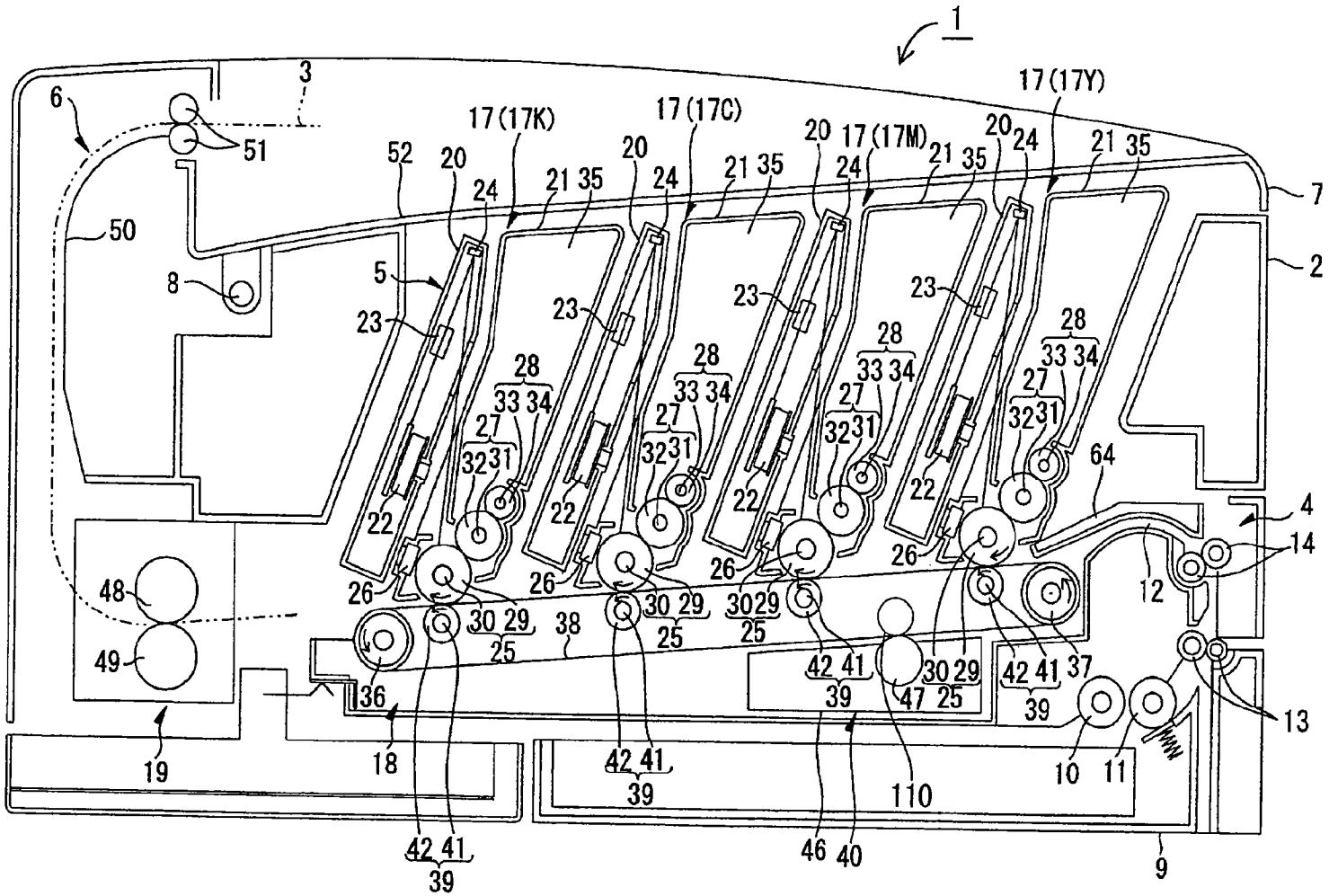
FIG. 1 is a sectional side view that schematically shows an embodiment of a color laser printer as an image forming apparatus.

FIG. 1 is a sectional side view that shows an exemplary structure of a color laser printer as an image forming apparatus of this invention.

The color laser printer 1 (hereunder, also referred to simply as "laser printer 1") is a side-by-side type tandem color laser printer in which a plurality of process portions 17 are disposed parallel to each other in a horizontal direction. In a main body casing 2, the color laser printer 1 includes a sheet feeding portion 4, for feeding a sheet 3 as a recording medium, an image forming portion 5 for forming an image on the fed sheet 3, and a sheet discharging portion 6 for discharging the sheet 3 on which an image was formed.

The main body casing 2 is formed in the shape of a substantially rectangular box, when viewed from the side, in which the top side is open. A top cover 7 is provided on the top side of the main body casing 2. The top cover 7 is supported so that it is configured to pivotally move around a cover shaft 8 that is provided at the rear side of the main body casing 2 (in the description hereunder, the left side of FIG. 1 is considered the rear and the right side is considered the front). Additionally, the top cover 7 is provided in a condition in which it can freely open and close with respect to the main body casing 2.

The sheet feeding portion 4 includes a sheet supply tray 9 that is provided at the inside bottom of the main body casing 2. A sheet feeding roller 11 and a pickup roller 10 are provided as a feeding device at an upper position at the front side of the sheet supply tray 9. A sheet feeding side U-shaped path 12 is provided upward of the front side of the sheet feeding roller 11. Additionally, a pair of conveying rollers 13 and a pair of registration rollers 14 are provided partway along the sheet feeding side U-shaped path 12.

The sheet supply tray 9 can be withdrawn from the main body casing 2. Sheets 3 are stacked inside of the sheet supply tray 9. The sheet 3 that is at an uppermost position therein is initially picked up by the pickup roller 10 and conveyed forward. This sheet 3 is then fed to the sheet feeding side of the U-shaped path 12 by the sheet feeding roller 11.

The sheet feeding side U-shaped path 12 is formed as a substantially U-shaped conveyance path for the sheet 3 in which an upstream side end (with respect to the sheet conveying direction) adjoins the sheet feeding roller 11 at a lower region so that the sheet 3 is fed towards the front. A downstream side end adjoins a conveying belt 38, to be described later, at an upper region so that the sheet 3 is discharged towards the rear.

The sheet 3 that was fed towards the front at the upstream side end of the sheet feeding side U-shaped path 12 is conveyed by the conveying rollers 13 inside of the sheet feeding side U-shaped path 12. After the conveying direction is altered to the rear and registration is performed by the registration rollers 14, the sheet 3 is discharged towards the rear by the registration rollers 14.

The image forming portion 5 includes process portions 17, a transferring portion 18, and a fixing portion 19.

The process portions 17 are provided for each toner of a plurality of colors (i.e., toner also corresponds to developer). More specifically, the process portions 17 include four process portions, a yellow process portion 17Y, a magenta process portion 17M, a cyan process portion 17C, and a black process portion 17K. The process portions 17 are provided in a condition in which they are spaced apart from each other in the front to rear direction. In addition, the process portions 17 are sequentially disposed in a parallel manner so as to overlap in a horizontal direction.

Each of the process portions 17 includes a scanner unit 20, as an exposing apparatus that is fixedly provided in each of the process portions 17, and a process cartridge 21 that is detachably mounted in each of the process portions 17.

The scanner unit 20 corresponds to an example of a laser beam irradiating device and includes a laser emitting portion (not shown), a polygon mirror 22, a lens 23, and a reflecting mirror 24. In the scanner unit 20, a laser beam (based on image data), which is emitted from the laser emitting portion, is reflected by the polygon mirror 22 so as to pass through the lens 23. The laser beam is then reflected by the reflecting mirror 24 and emitted in the direction of the photosensitive drum 25 (to be described later).

Each process cartridge 21 is provided in a detachable configuration along a direction that is inclined with respect to the front to rear direction and the vertical direction (i.e., the direction of the thickness of sheet 3). In other words, the process cartridges 21 are configured in a direction that inclines to the front from the lower part towards the upper part (i.e., a direction in which the upper part inclines to the front side). Each process cartridge 21 includes a photosensitive drum 25 as a photosensitive member, a scorotron charging device 26, a developing roller 27, and a supply roller 28.

The photosensitive drum 25 (which also correspond to an example of a photosensitive member) is formed in a cylindrical shape. The photosensitive drum 25 includes a drum main body 29, on which the outermost layer is formed of a positively charged photosensitive layer made of polycarbonate or the like, and a drum shaft 30 that extends along an axial direction of the drum main body 29 at the axial core of the drum main body 29.

The drum main body 29 is provided in a rotatable condition with respect to the drum shaft 30. In this exemplary structure, the drum shaft 30 is supported in a non-rotatable condition at two side walls in the width direction (i.e., a direction orthogonal to both the front and rear directions, and the vertical direction) of a frame of the process cartridge 21. At the time of image formation, the photosensitive drum 25 is rotationally driven in the same direction (e.g., clockwise as viewed in FIG. 1) as the movement direction of a conveying belt 38 at a position of contact (i.e., an image forming position) with the conveying belt 38 (which is described later).

The scorotron charging device 26 comprises a wire and a grid. The scorotron charging device 26 is a scorotron-type charging device configured for developing a positive charge through the generation of a corona discharge. It is disposed facing a photosensitive drum 25 in a position at the rear side of the photosensitive drum 25. The scorotron charging device 26 is spaced apart from the photosensitive drum 25 by a specified interval so as not to come in contact therewith.

The developing roller 27 (which corresponds to an example of a developing device) is disposed facing the photosensitive drum 25 in a position upward of the photosensitive drum 25. Additionally, the developing roller 27 configured to be pressed into contact with the photosensitive drum 25. The developing roller 27 is formed from a metal roller shaft 31 covered by a roller portion 32. The roller portion 32 comprises a resilient member such as a conductive rubber material.

The supply roller 28 is disposed facing the developing roller 27 at a position upward thereof, and is pressed into contact with the developing roller 27. The supply roller 28 is formed from a metal roller shaft 33 covered by a roller portion 34. The roller portion 34 comprises a conductive sponge member. The roller shaft 33 is rotatably supported at two side walls in the width direction of the process cartridge 21.

The upper portion inside of each process cartridge 21 is formed as a toner containing chamber 35 configured to contain toner. Each toner containing chamber 35 contains a single color of toner in this illustrative aspect. More specifically, a positive charging nonmagnetic one-component polymerized toner for yellow, magenta, cyan, and black, is respectively contained inside of a corresponding toner containing chamber 35 of each process portion 17. In other words, yellow toner is contained in the yellow process portion 17Y, magenta toner is contained in the magenta process portion 17M, cyan toner is contained in the cyan process portion 17C, and black toner is contained in the black process portion 17K.

For each process portion 17, the toner for the color that is contained in the toner containing chamber 35 is supplied to the supply roller 28 at the time of an image formation operation. Subsequently, the toner is supplied to a corresponding developing roller 27 via the rotation of the supply roller 28. At this time, the toner is triboelectrically charged for a positive charge between the supply roller 28 and the developing roller 27, to which a developing bias is applied.

Meanwhile, the scorotron charging device 26 generates a corona discharge through the application of a charging bias in order to charge a portion of the surface of the photosensitive drum 25 to a uniform positive charge.

As the photosensitive drum 25 rotates, an increasing surface area of the photosensitive drum 25 is uniformly charged to a positive charge by the scorotron charging device 26. The surface is subsequently exposed via high-speed scanning by a laser beam from the scanner unit 20, thereby forming an electrostatic latent image thereon that corresponds to the image to be formed upon the sheet 3.

As the photosensitive drum 25 further rotates the toner is supplied to the electrostatic latent image formed on the surface of the photosensitive drum 25 when the positively charged toner, which is carried on the surface of the developing roller 27, faces (i.e., opposes) and comes in contact with the photosensitive drum 25 via the rotation of the developing roller 27. More specifically, the toner is only supplied to the exposed portions of the surface of the photosensitive drum 25. In other words, when the laser beam exposes portions of the uniformly positively charged surface of the photosensitive drum 25, the electric potential drops at the exposed portion. Thereby, an electrostatic latent image is visualized on the photosensitive drum 25, and a toner image formed by reversal development is carried on the surface of the photosensitive drum 25 for each color.

The transferring portion 18 is disposed in the main body casing 2 along the front to rear direction, below the process portions 17, at a position that is upward of the sheet feeding portion 4. The transferring portion 18 comprises a driving roller 36, a driven roller 37, a conveying belt 38, transfer rollers 39, and a belt cleaning apparatus 40.

A driving roller 36 is disposed at a position of relatively low height that is more rearward than the photosensitive drum 25 of the process cartridge 21 mounted in the black process portion 17K. The driving roller 36 is positioned such that it does not overlap with the photosensitive drum 25 in the horizontal direction. At the time of image formation, the driving roller 36 is rotationally driven in an opposite direction (e.g., a counter clockwise direction as viewed in FIG. 1) to the rotational direction of the photosensitive drum 25, by an unshown main motor 96 (see FIG. 2; omitted from FIG. 1).

A driven roller 37 is disposed at a position that is further upward than the driving roller 36 and nearer to the front than the photosensitive drum 25 of the process cartridge 21 mounted in the yellow process portion 17Y. At the time of rotational driving of the driving roller 36, the driven roller 37 is driven to rotate in the same direction (e.g., a counterclockwise direction as viewed in the figure) as the movement direction of the conveying belt 38, at a portion at which the driven roller 37 contacts with the conveying belt 38 (described hereafter).

The conveying belt 38 (corresponding to an example of a common image bearing member) comprises an endless belt. The conveying belt 38 is formed by a resin, such as conductive polycarbonate or polyimide, in which conductive particles such as carbon are dispersed. The conveying belt 38 is wound between the driving roller 36 and the driven roller 37. The driven roller 37 is driven by driving of the driving roller 36. The conveying belt 38 is rotationally moved between the driving roller 36 and the driven roller 37 so as to travel in the same direction as the photosensitive drums 25 at the image forming positions in which the conveying belt 38 faces and comes in contact with the photosensitive drums 25 of each of the process portions 17.

Each transfer roller 39 is disposed inside of the perimeter of the conveying belt 38 that is wound between the driving roller 36 and the driven roller 37. A transfer roller 39 is disposed in a condition in which the transfer roller 39 opposes the corresponding photosensitive drum 25 of each process portion 17, so as to sandwich or contain the conveying belt 38 between a transfer roller 39 and a corresponding photosensitive drum 25. Each transfer roller 39 is formed from a metal roller shaft 41 covered by a roller portion 42, which comprises a resilient member such as a conductive rubber material. In each transfer roller 39, the two shaft ends of the roller shaft 41 are supported in a freely rotatable manner on conductive bearings (not shown) in this illustrative aspect. A transfer bias is applied to the transfer rollers 39 through the bearings.

The belt cleaning apparatus 40 is provided in a relatively large space (i.e., a larger space than the space formed nearer to the side of the driving roller 36) that is formed nearer to the side of the driven roller 37, underneath the conveying belt 38. The belt cleaning apparatus 40 (e.g., the cleaning apparatus 40 also corresponds to an example of a cleaning device) includes a cleaning box 46 and a cleaning roller 47. A backup roller 110 is provided inside of the perimeter of the conveying belt 38 at a position facing the cleaning roller 47 (the cleaning roller 47 also corresponds to an example of a contact component).

The fixing portion 19 is disposed at the rear of the transferring portion 18. The fixing portion 19 includes a heat roller 48 and a pressure roller 49.

The heat roller 48 is composed by a metallic tube having a release layer formed on the surface thereof. In addition, the heat roller 48 contains a halogen lamp along the axial direction thereof. The surface of the heat roller 48 is heated to a fixing temperature by the halogen lamp. The pressure roller 49 is provided so as to press against the heat roller 48.

A color image that was transferred onto the sheet 3 is subsequently conveyed to the fixing portion 19, and is heated and fixed onto the sheet 3 while the sheet 3 passes between the heat roller 48 and the pressure roller 49.

The sheet discharging portion 6 includes a discharge side U-shaped path 50, discharge rollers 51, and a discharge tray 52.

The discharge side U-shaped path 50 is formed as a substantially U-shaped conveyance path for the sheet 3 that discharges the sheet 3 towards the front of the color laser printer 1. The U-shaped path 50 includes an upstream side end that adjoins the fixing portion 19 at a lower region, and a downstream side end that adjoins the discharge tray 52 at an upper region (upstream and downstream are determined relative to the conveying direction of the sheet 3). The sheet 3 is initially fed towards the rear.

The discharge rollers 51 are provided as a pair of rollers at the downstream side end of the discharge side U-shaped path 50.

The discharge tray 52 is formed on the top surface of the main body casing 2 as an inclined surface that inclines upward from the rear to the front.

A sheet that is conveyed from the fixing portion 19 is fed towards the rear at the upstream side end of the discharge side U-shaped path 50. The conveying direction is then modified within the discharge side U-shaped path 50 so that the sheet is discharged towards the front onto the discharge tray 52 by the discharge rollers 51.

2. Electrical Configuration

An exemplary structure of the electrical configuration of the above laser printer 1 will be described next.

Figure 2:
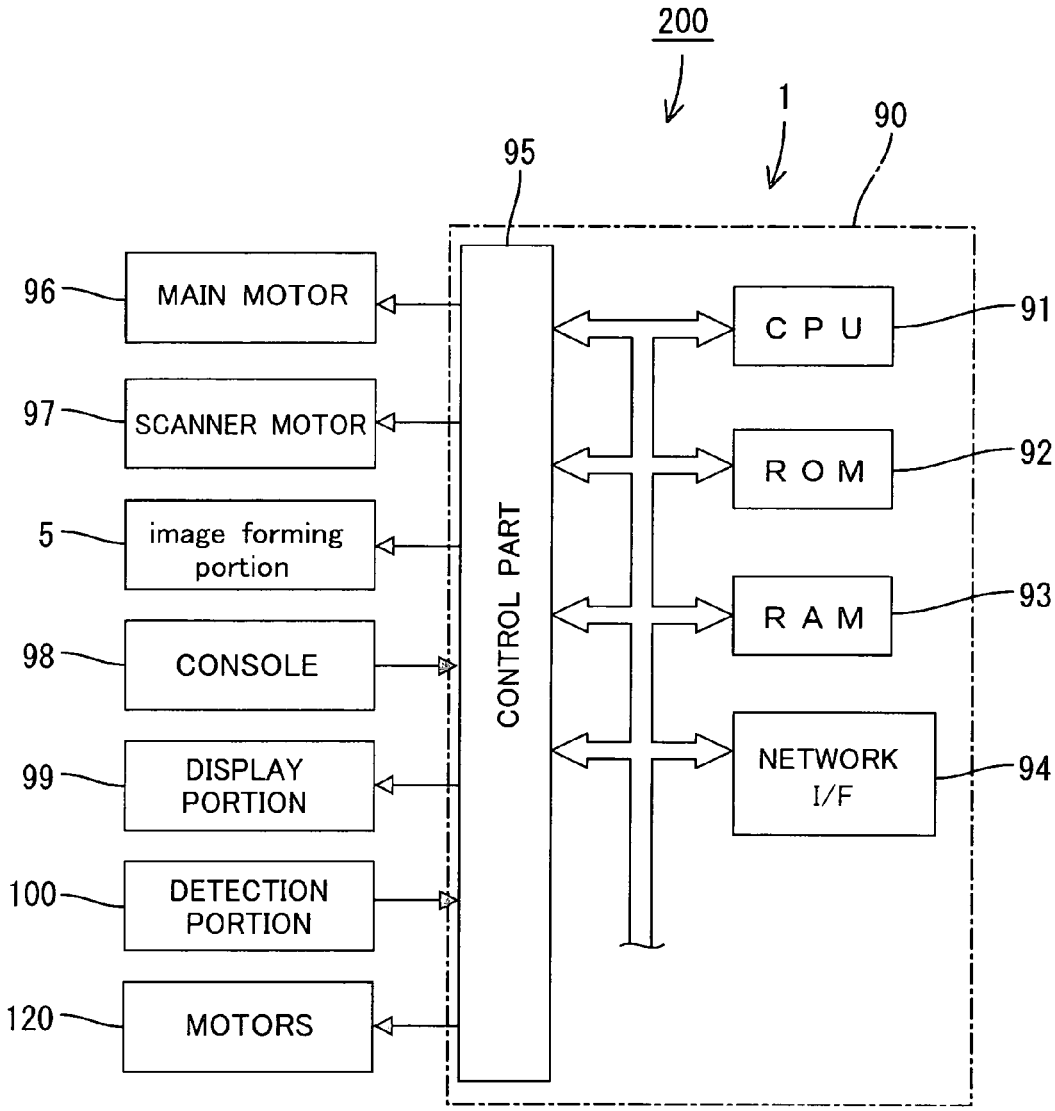
FIG. 2 is a block diagram that conceptually shows the electrical configuration of the color laser printer shown in FIG. 1.

FIG. 2 is a block diagram that conceptually shows the electrical configuration of the laser printer 1.

As shown in FIG. 2, the laser printer 1 is composed of a control apparatus 90 that controls each component by use of a CPU 91, a ROM 92, a RAM 93, and a control part 95 comprising an ASIC (Application Specific Integrated Circuit). The laser printer 1 is also provided with a main motor 96, a scanner motor 97, a console 98 comprising an input panel and the like, a display portion 99 comprising various lamps and the like, and a detection portion 100 comprising various sensors and the like, in a condition in which they are electrically connected to the control part 95. These components make up an example of a control system.

The ROM 92 and the RAM 93 are connected to the CPU 91. The CPU 91 controls each component through the control part 95 in accordance with procedures stored in the ROM 92, while storing the processing results in the RAM 93.

The main motor 96 is a motor that rotates the above described conveying belt 38 and the like. The scanner motor 97 is a motor that rotates a polygon mirror 22 inside of a scanner unit 20.

The CPU 91 controls the driving of the main motor 96 and the scanner motor 97 based upon programs that were previously stored in the ROM 92.

The control part 95 controls the image forming portion 5 in accordance with instructions from the CPU 91. More specifically, the control part 95 performs exposure control to expose the surface of the photosensitive drum 25 using parts configuring the scanner unit 20. In addition, the control part 95 controls the transfer bias when transferring toner onto the sheet 3 and the like.

The control apparatus 90 is also provided with a network interface 94 (network I/F) for connecting external devices such as a personal computer.

The detection portion 100 is composed of various sensors. These sensors are electrically connected to the control part 95.

Figure 3:
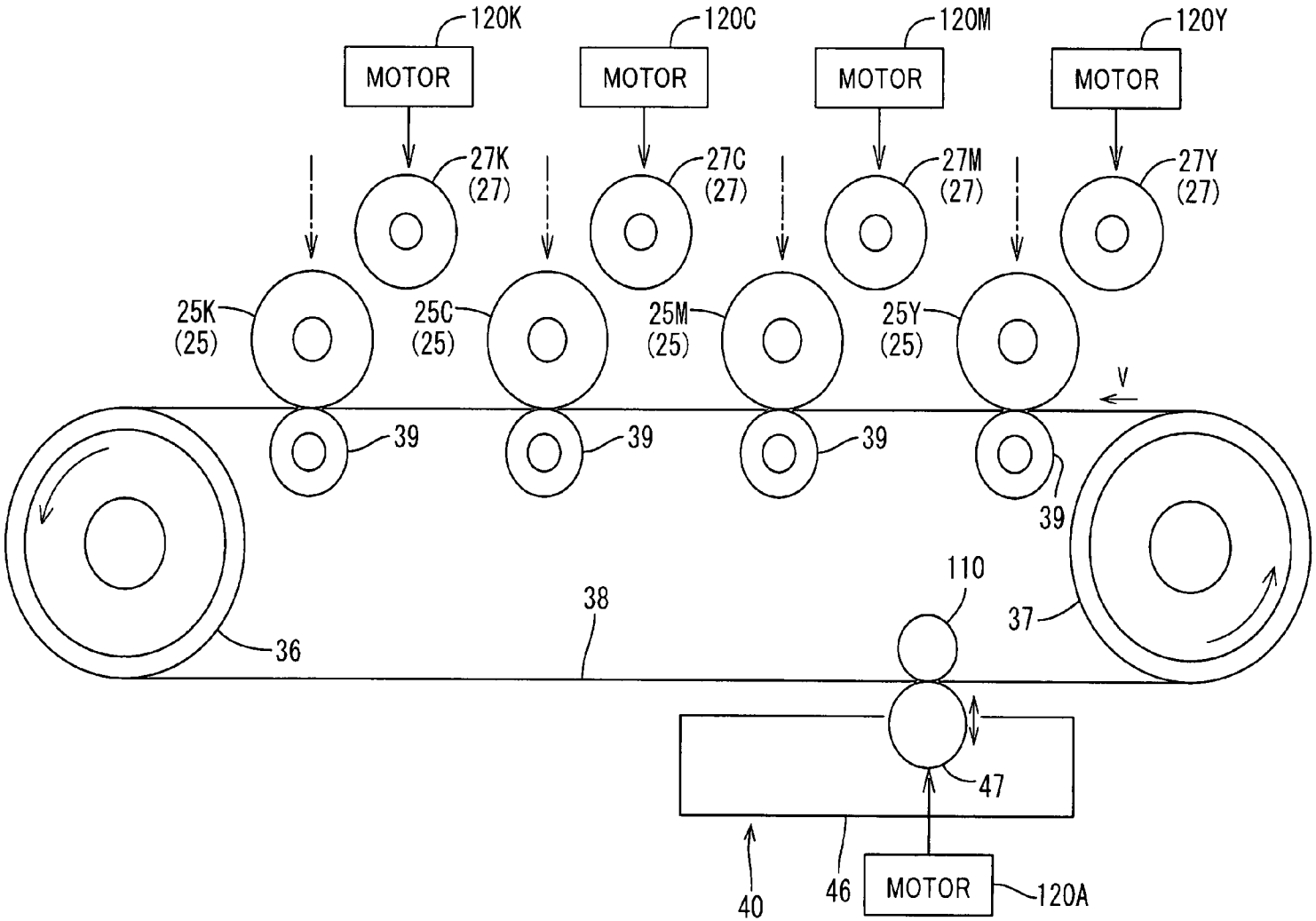
FIG. 3 is an explanatory drawing that conceptually explains the relationship between the developing rollers, photosensitive drums, a conveying belt, and the like, and which shows a state in which all of the developing rollers are separated from their respective photosensitive drums.

Motors 120 is the generic name given to a plurality of motors 120K, 120C, 120M, 120Y, and 120A (see FIG. 3). The motors 120 are electrically connected to the control part 95 and are configured to be driven based upon a signal from the control part 95. More specifically, the motors 120K, 120C, 120M, and 120Y, (FIG. 3) cause the developing rollers 27K, 27C, 27M, and 27Y, to respectively change positions. The motor 120A (FIG. 3) causes the cleaning roller 47 to change positions. These motors 120K, 120C, 120M, 120Y, and 120A (FIG. 3) are respectively driven by unshown drive circuits. The control part 95 can independently output signals to the drive circuit of each motor 120K, 120C, 120M, 120Y, and 120A (FIG. 3).

3. Examples of Characteristic Parts

As shown in FIG. 1, according to the present illustrative aspect the developing rollers 27 are respectively provided at the perimeter of a plurality of photosensitive drums 25. In each of the developing rollers 27, a roller portion 32 is formed by a two-layer structure including a roller part, configured by a resilient member comprising conductive urethane rubber, silicone rubber, or EPDM rubber including carbon microparticles or the like, and a coat layer, which is coated around the surface of the roller part and includes urethane rubber, urethane resin, polyimide resin or the like, as a main component. The roller shaft 31 is supported in a freely rotatable manner by both side walls in the width direction of the process cartridge 21.

Figure 4:
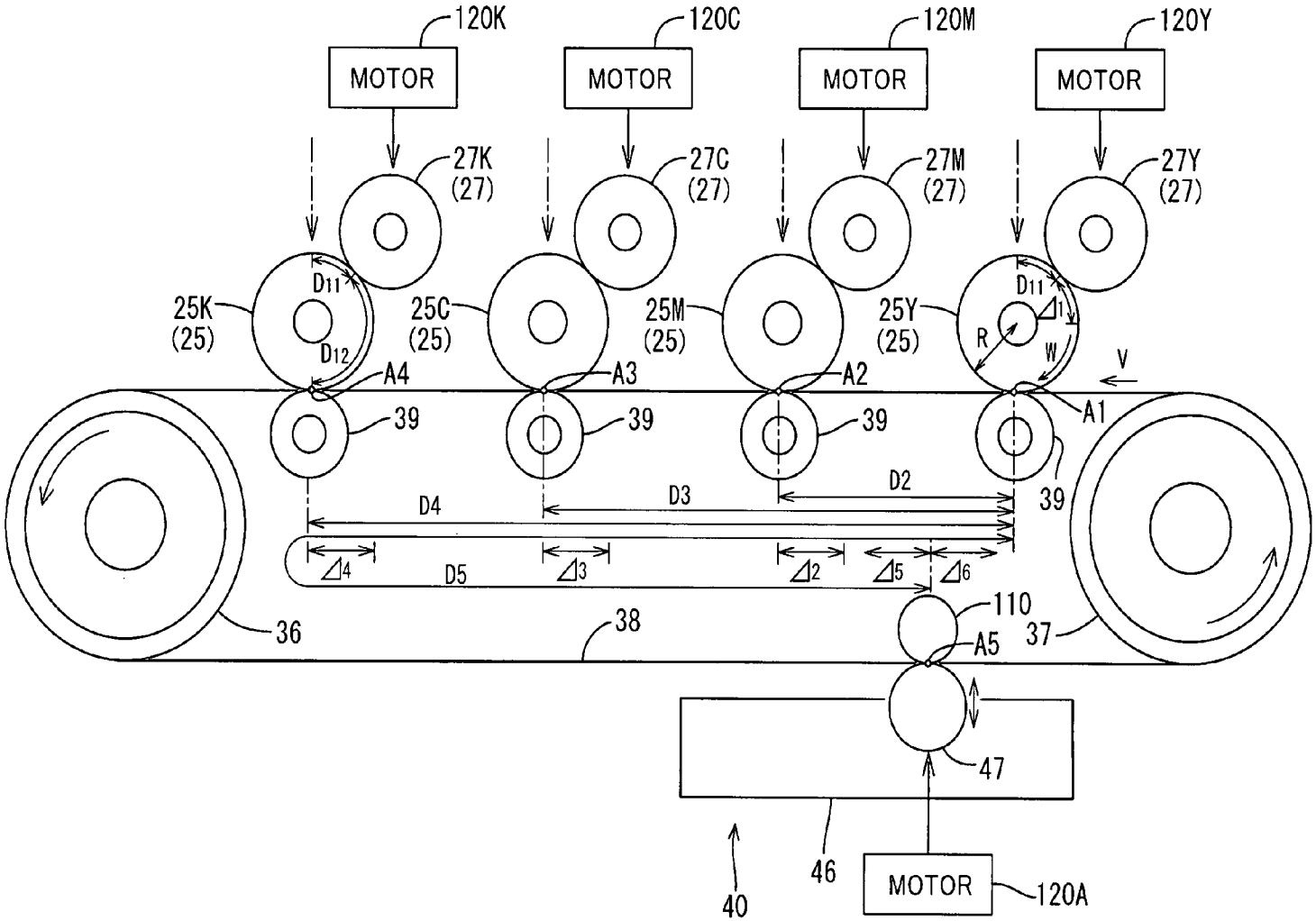
FIG. 4 is an explanatory drawing that conceptually explains the relationship between the developing rollers, photosensitive drums, the conveying belt, and the like, and which shows a state in which all of the developing rollers are in contact with their respective photosensitive drums.

Each developing roller 27 that is constructed in this manner can change positions between a separated position, as conceptually shown in FIG. 3, and a developing position adjacent to the photosensitive drum 25, as shown in FIG. 4. More specifically, as shown in FIGS. 3 and 4, a plurality of motors 120K, 120C, 120M, and 120Y, which can be respectively and independently controlled by the control part 95 (FIG. 2), is provided to correspond to the developing rollers 27K, 27C, 27M, and 27Y. Upon receiving a driving force from the motors 120, the respective developing rollers 27K, 27C, 27M, and 27Y, change positions between a developing position and a separated position.

Furthermore, each motor comprises a stepping motor or the like. Revolution of this motor is converted into a linear movement using a conversion mechanism (for example, a conversion mechanism using rubber belts, gears, or the like) to cause the respective developing rollers 27K, 27C, 27M, and 27Y, to change positions between a developing position and a separated position. However, a configuration may also be adopted in which, for example, the position of each developing roller 27 is changed using a solenoid or the like, without requiring the use of the above described motor and conversion mechanism.

Figure 5:
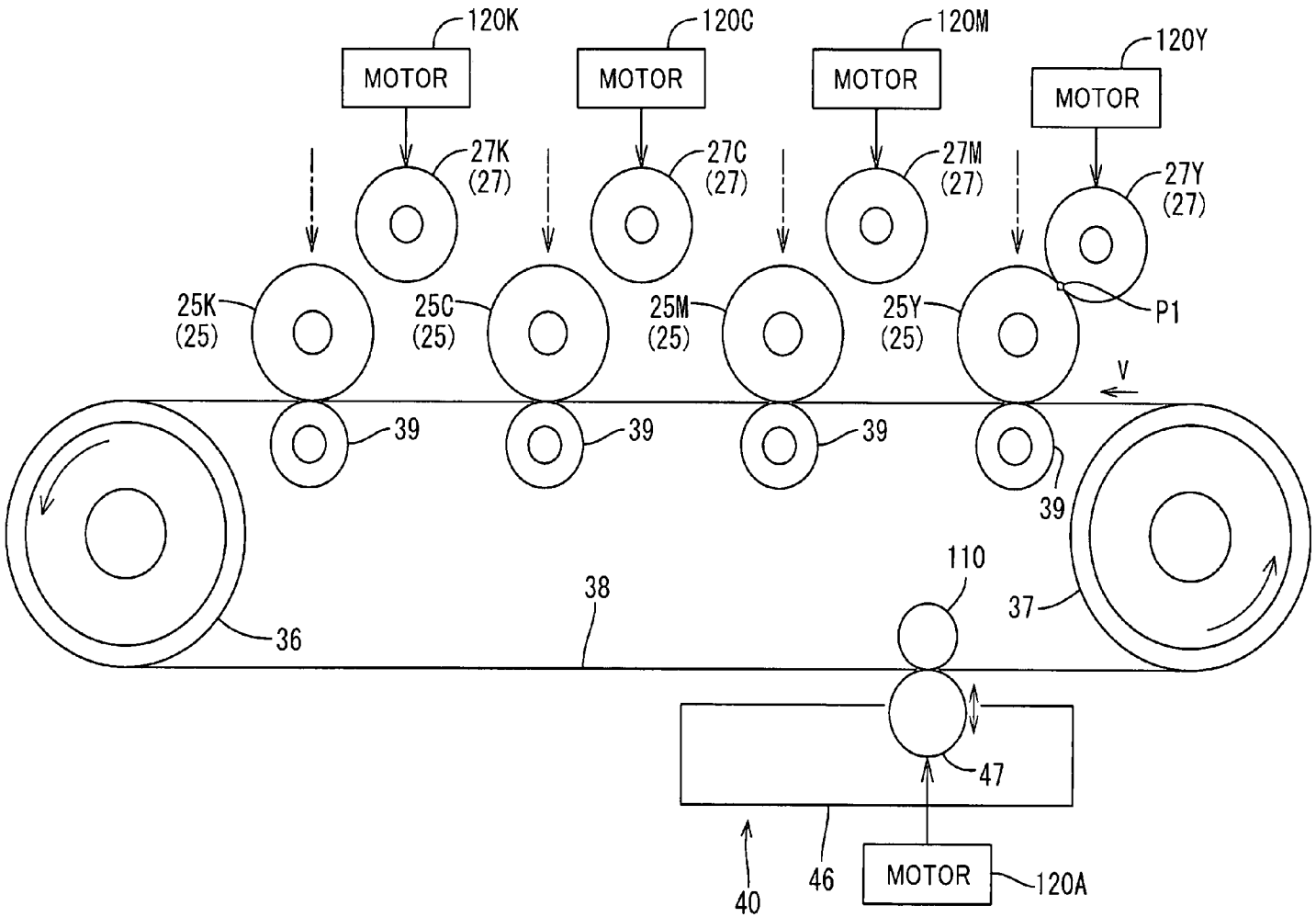
FIG. 5 is an explanatory drawing that conceptually explains the relationship between the developing rollers, photosensitive drums, the conveying belt, and the like, and which illustrates the state at a point in time when a developing roller 27Y has changed positions to a developing position.
Figure 6A:
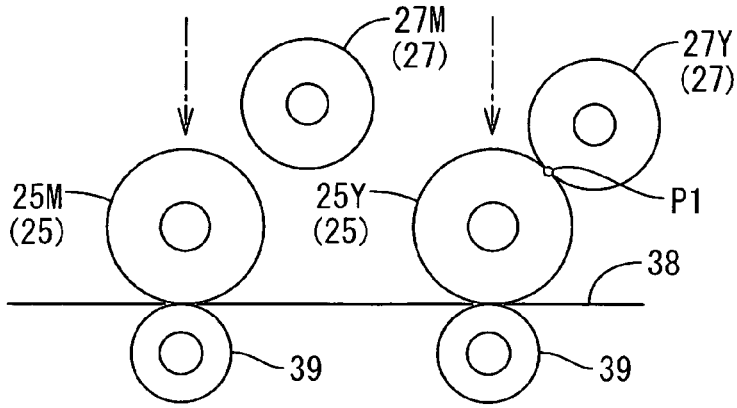
FIGS. 6A, 6B, and 6C, are explanatory drawings for detailing the operations from a point in time when the developing roller 27Y has changed positions to a developing position.

According to this exemplary aspect, as shown in FIG. 5 and FIG. 6A, accompanying the start of recording preparations the developing roller 27Y (the developing roller 27Y corresponds to an example of the first developing device), from among the four developing rollers 27, initially changes positions to a developing position. A first position P1 is taken as the position of the photosensitive drum 25Y that directly opposes the developing roller 27Y at the point in time when the developing roller 27Y is moved to a developing position (i.e., the timing at which the developing roller 27Y comes closest to the photosensitive drum 25Y and is stopped).

Figure 6B:
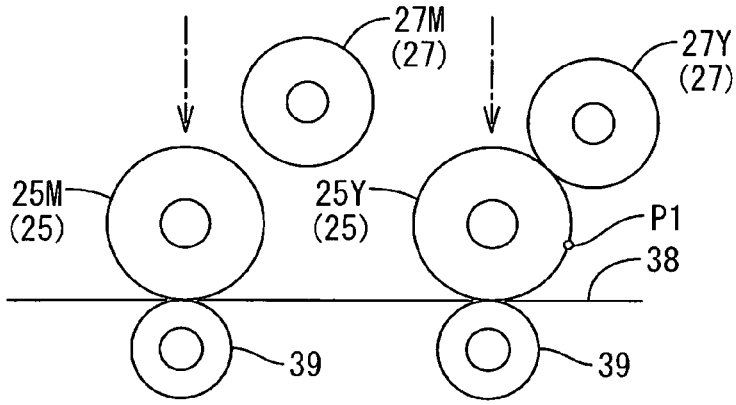
Figure 6C:
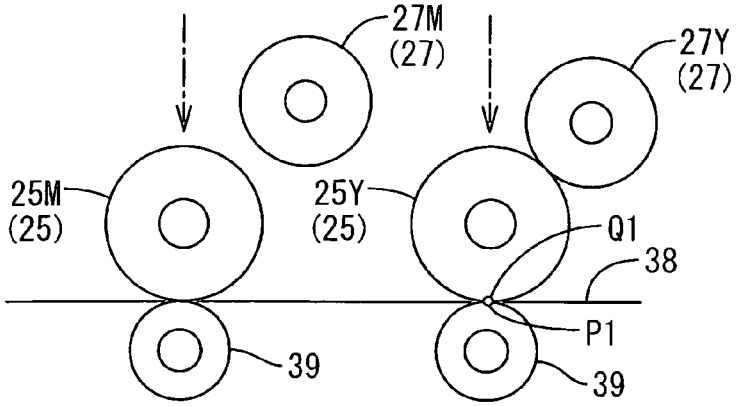

As shown in FIG. 6B, this first position P1 moves along with the rotation of the photosensitive drum 25Y. Thereafter, the first position P1 faces (contacts) the conveying belt 38 as shown in FIG. 6C. The portion of the conveying belt 38 that corresponds to the first position P1 (i.e. the portion of the conveying belt 38 that contacts the first position P1) is taken to be a first corresponding portion Q1.

Figure 7A:
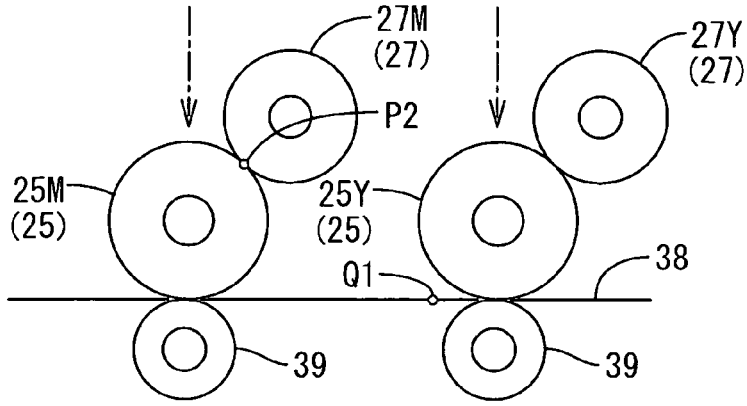
FIGS. 7A, 7B, and 7C, are explanatory drawings for detailing the operations from a point in time when a developing roller 27M has changed positions to a developing position.

Further, as shown in FIG. 7A, after the developing roller 27Y has changed positions, a developing roller 27M, different than the developing roller 27Y (the developing roller 27M corresponds to an example of the second developing device), changes positions to a developing position. A second position P2 is taken as the position of the photosensitive drum 25 that faces the developing roller 27M at the point in time when the developing roller 27M has moved to a developing position (i.e., the timing at which the developing roller 27M comes closest to the photosensitive drum 25M and is stopped).

Figure 7B:
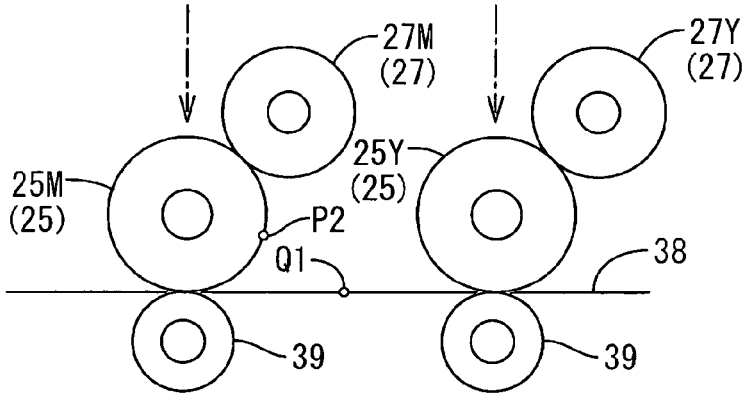
Figure 7C:
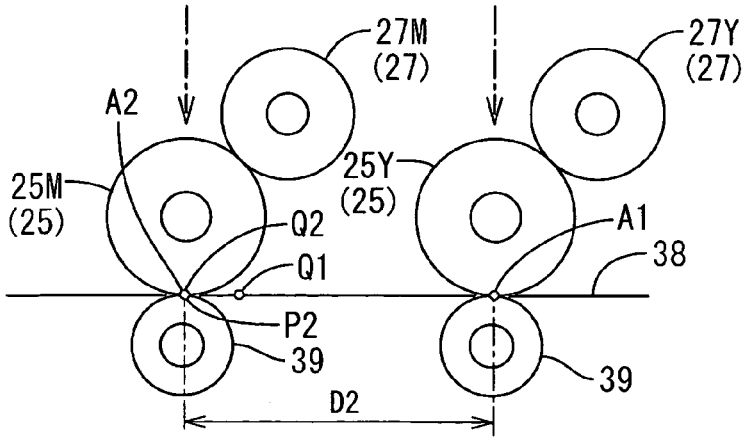

As shown in FIG. 7B, this second position P2 also moves along with the rotation of the photosensitive drum 25M. Subsequently, as shown in FIG. 7C, the second position P2 faces (contacts) the conveying belt 38. The portion of the conveying belt 38 that corresponds to the second position P2 (i.e. the portion of the conveying belt 38 that contacts the second position P2) is taken to be a second corresponding portion Q2.

According to this aspect, as shown in FIG. 7C, the timing for changing the positions of the developing roller 27M and the developing roller 27Y is controlled via the control of the control apparatus 90 and the motors 120 such that the distance between the first corresponding portion Q1 and the second corresponding portion Q2 is less than a distance D2 (i.e., reference distance). The distance D2 is established as the distance created if the developing roller 27Y and the developing roller 27M simultaneously approached their respective photosensitive drums 25.

In this connection, according to this illustrative aspect, when the developing roller 27Y and the developing roller 27M simultaneously approach their photosensitive drums 25, the first position P1 on the photosensitive drum 25Y, which faces the developing roller 27Y at the time of approach, and the second position P2 on the photosensitive drum 25M, which faces the developing roller 27M at the time of approach, come into contact with the conveying belt 38 at approximately the same time. In this case, the distance between the first corresponding portion Q1 and the second corresponding portion Q2 is equal to the distance D2 (refer also to FIG. 4).

The distance D2 is the distance between a contact position A1 at which the photosensitive drum 25Y contacts the conveying belt 38, and a contact position A2 at which the photosensitive drum 25M contacts the conveying belt 38. Consequently, the distance D2 is established as a reference distance. According to the present exemplary structure, by controlling the timing for changing the positions of the developing rollers 27 as described above, a distance between the first corresponding portion Q1 and the second corresponding portion Q2 becomes shorter than the distance D2. In this regard, the control apparatus 90 and the motors 120K, 120C, 120M, and 120Y, correspond to position changing devices.

According to this configuration, since it is possible to narrow the distance on the conveying belt 38 between the first corresponding portion Q1, which is affected by the movement of the developing roller 27Y approaching a corresponding photosensitive member, and the second corresponding portion Q2, which is affected by the movement of the developing roller 27M approaching a corresponding photo sensitive member, measures to cope with the effects on the conveying belt 38 of these approaching movements can be efficiently performed.

The attachment of unwanted toner on the conveying belt 38 may be referenced as an example of the effects of such approaching movements. In other words, in the laser printer 1 it is possible for toner from each developing roller 27 to be transferred onto the conveying belt 38 (the conveying belt 38 corresponds to an example of an image bearing member and a common image bearing member) facing the photosensitive drums 25. A situation may occur in which toner adheres to a photosensitive member when a developing roller 27 moves to a developing position, due to the impact of such movement or the like. As a result, there is a concern that unintended toner (i.e. toner unrelated to normal image formation) from a developing roller 27 will become attached to the conveying belt 38 as the common image bearing member.

Thus, according to this aspect, the cleaning apparatus 40 is provided as described above. In addition, it is also possible through the use of the above described control processes to narrow the area on the conveying belt 38 in which the attachment of toner is assumed to occur (e.g., due to the aforementioned approach movements). Therefore, even if a situation arises in which toner does become attached to the first position P1 and the second position P2, cleaning can be effectively performed.

Furthermore, as shown in FIG. 3 and the like, according to this exemplary structure the cleaning roller 47 in the cleaning apparatus 40 is capable of contacting with and separating from the conveying belt 38. This contact timing and separation timing can also be controlled. More specifically, by controlling the motor 120A (which transfers a force to the cleaning roller 47) with the control apparatus 90, the cleaning roller 47 can be caused to change positions between a close position, at which it contacts with the conveying belt 38, and a separated position, at which it is separated from the conveying belt 38, in order to control the contact timing of the cleaning roller 47. Accordingly, by only allowing the cleaning roller 47 to contact the conveying belt 38 in the vicinity of a narrowed toner attachment area, deterioration of the components can be effectively prevented and cleaning can be efficiently performed.

In this exemplary structure, the motor 120A includes a stepping motor or the like. Revolution of the motor 120A is converted into a linear movement using a conversion mechanism (for example, a conversion mechanism using rubber belts, gears, or the like), and transferred to the cleaning roller 47. However, any other method may be employed with respect to the motor 120A as long as it is a driving structure that allows the cleaning roller 47 to approach and withdraw from the conveying belt 38. For example, the cleaning roller 47 may be caused to change positions using a solenoid or the like.

Figure 8A:
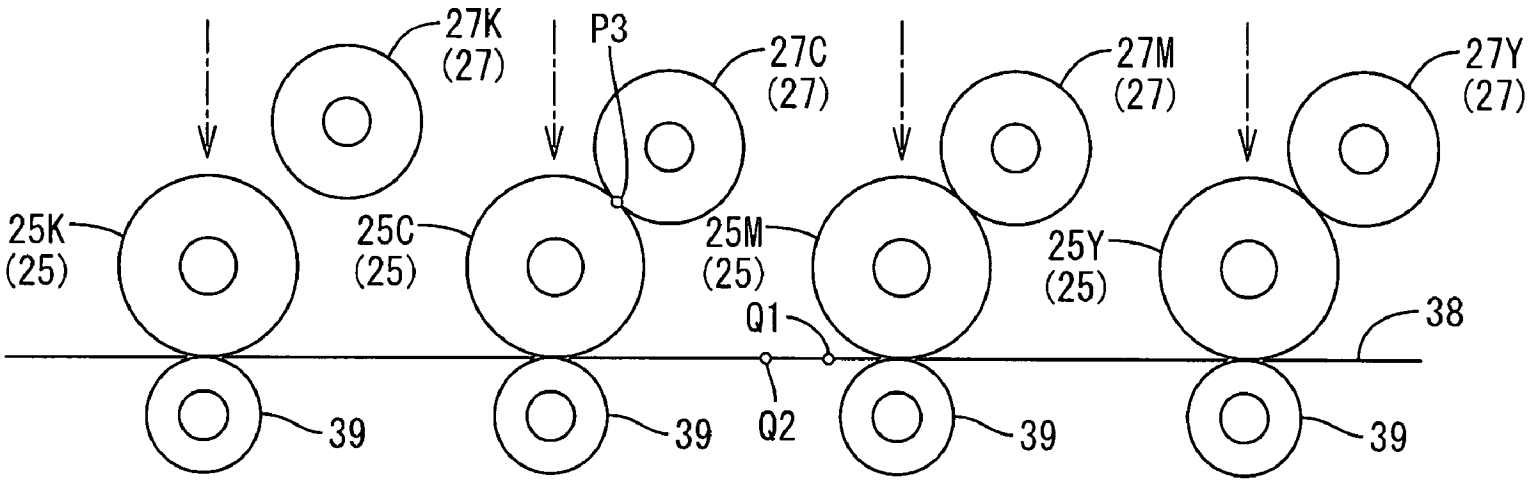
FIGS. 8A and 8B are explanatory drawings for detailing the operations from a point in time when a developing roller 27C has changed positions to a developing position.
Figure 8B:
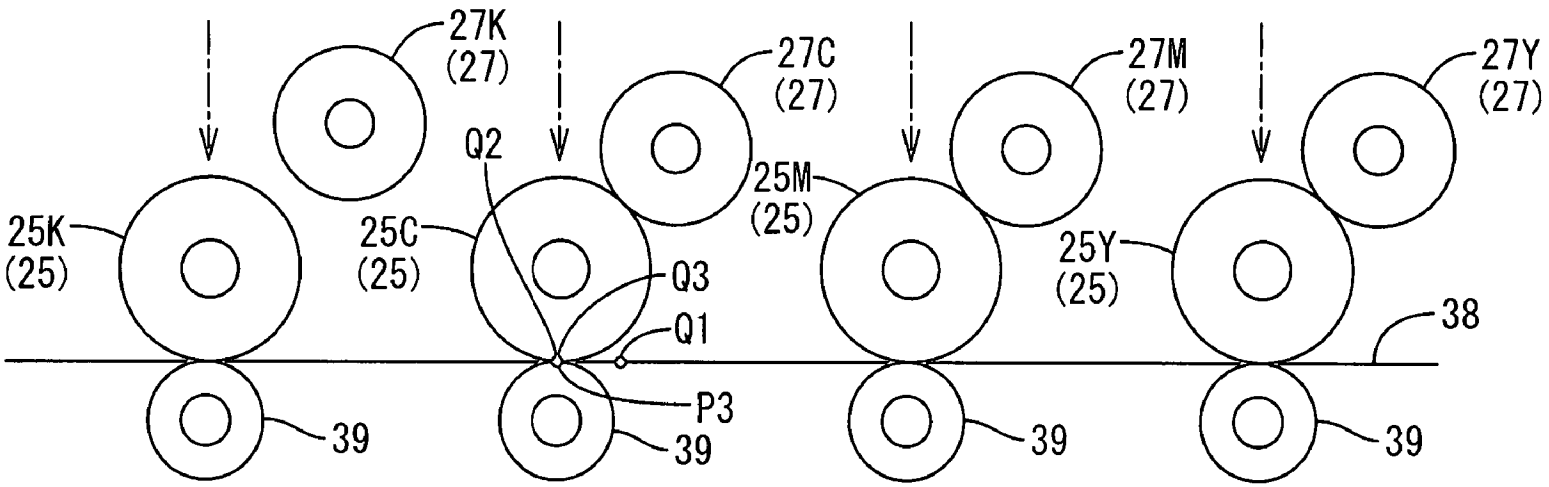
Figure 9A:
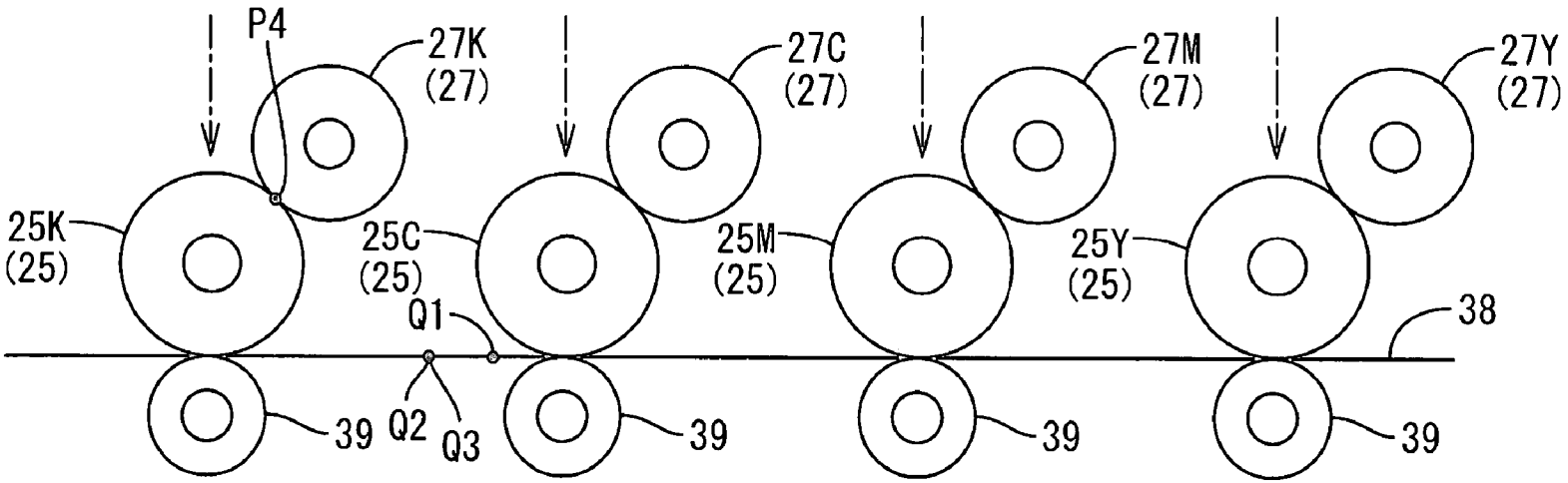
FIGS. 9A and 9B are explanatory drawings for detailing the operations from a point in time when a developing roller 27K has changed positions to a developing position.
Figure 9B:
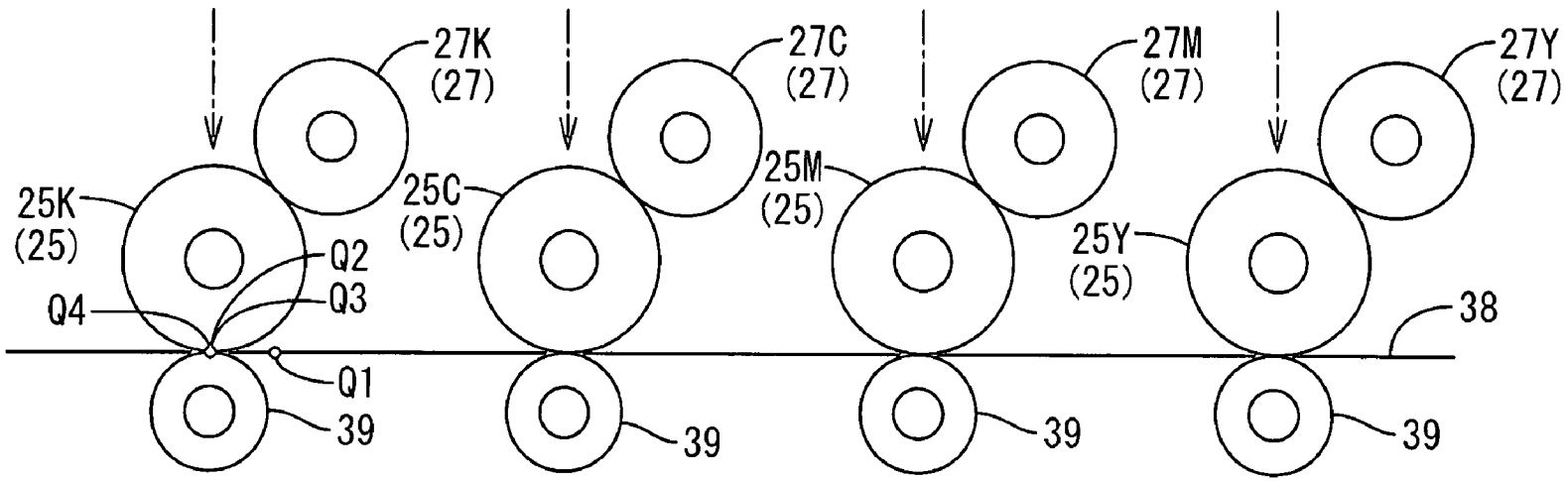

The operations of the other developing rollers will be described next with reference to FIG. 8 and FIG. 9. FIG. 8A is an explanatory drawing that conceptually describes the state at a point in time when the developing roller 27C contacts the photosensitive drum 25C. FIG. 8B is an explanatory drawing that describes the state at a point in time when a position P3 contacts the conveying belt 38. FIG. 9A is an explanatory drawing that conceptually describes the state at a point in time when the developing roller 27K contacts the photosensitive drum 25K. FIG. 9B is an explanatory drawing that describes the state at a point in time when a position P4 contacts the conveying belt 38.

As described above, the two developing rollers 27C and 27K are provided in addition to the developing roller 27Y and the developing roller 27M. As shown in FIG. 8A and FIG. 9A, the respective positions P3 and P4, which face the developing rollers 27C and 27K on the photosensitive drums 25C and 25K when the developing rollers 27C and 27K change positions to a developing position, are taken as third positions. As shown in FIG. 8B and FIG. 9B, the portions Q3 and Q4 on the conveying belt 38 (i.e., portions contacting with P3 and P4 on the photosensitive drums 25C and 25K), corresponding to the third positions P3 and P4, are taken as third corresponding portions.

As shown in FIG. 5, the developing roller 27Y, which is disposed furthest upstream, is controlled by the motor 120 and the control apparatus 90 so as to change positions to a developing position at an earlier timing than the other developing rollers 27M, 27C, and 27K. As a result of this control, as shown in FIG. 9B, the first corresponding portion Q1 is adjusted so that it is further on the upstream side of the conveying belt 38 than the second corresponding portion Q2 and third corresponding portions Q3 and Q4. As shown in FIG. 9B, the timing of the other developing rollers 27M, 27C, and 27K, are adjusted so that the second corresponding portion Q2 and both of the third corresponding portions Q3 and Q4 are established at the same position on the downstream side of the first corresponding portion Q1 on the conveying belt 38.

According to this configuration, even if a shift occurs at the positions of the second corresponding portion Q2 and the third corresponding portions Q3 and Q4, it is difficult for the second corresponding portion or the third corresponding portions to be positioned further upstream than the first corresponding portion Q1. It is therefore possible to effectively prevent the effect of a shift from spreading to the upstream side of the first corresponding portion Q1. Accordingly, it is possible to further decrease the area that is affected by the movements of all of the developing rollers 27 with their approaching of corresponding photosensitive members in regard to positional variations. In addition, the time required for image formation preparations can also be effectively decreased.

Hereunder, the flow of specific controls for realizing the above described concept will be described with reference to the flowcharts of FIG. 10 and FIG. 11.

Figure 10:
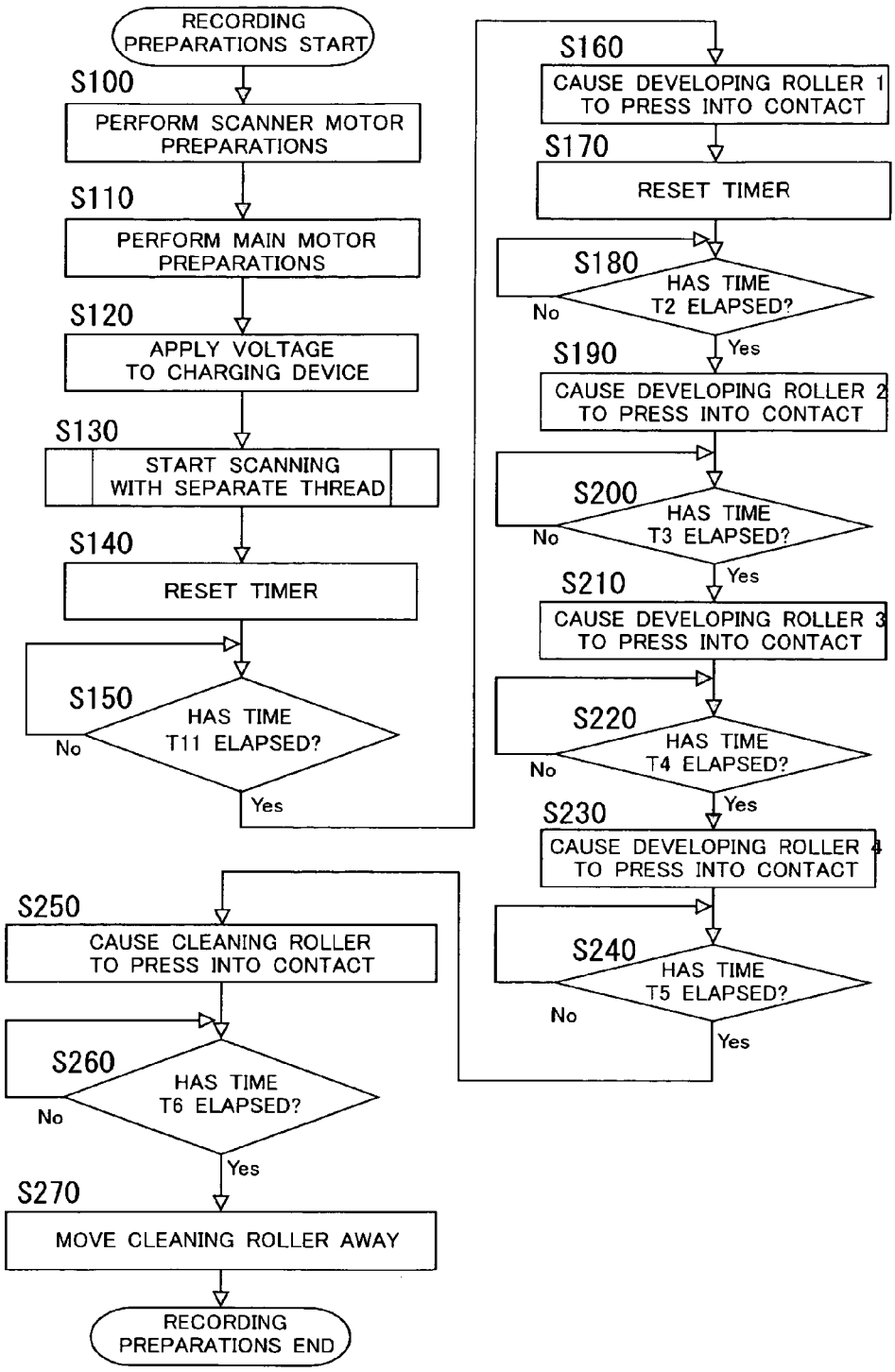
FIG. 10 is a flowchart illustrating the flow of recording preparation processing.
Figure 11:
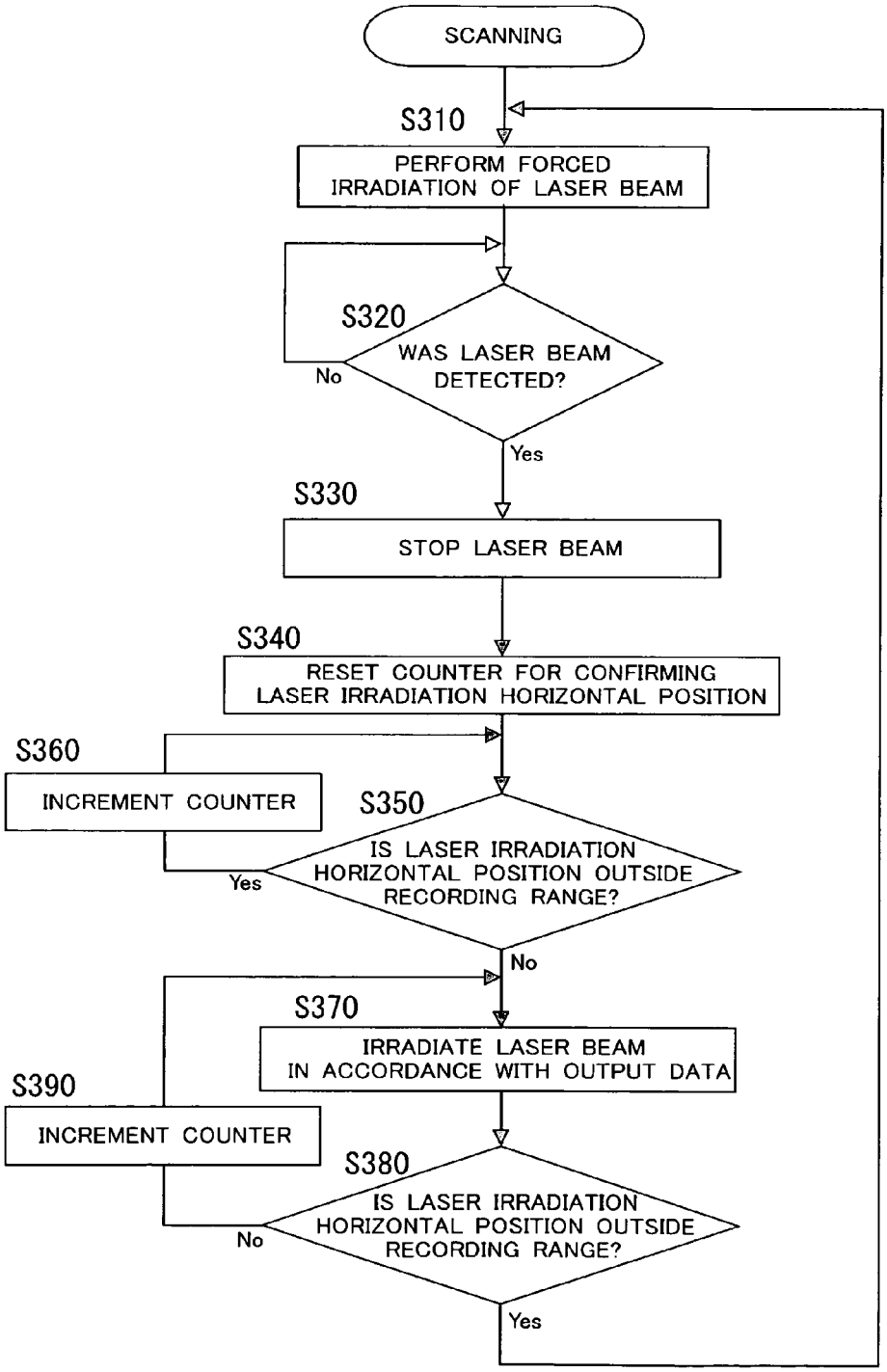
FIG. 11 is a flowchart illustrating the flow of scanning processing.

As shown in FIG. 10, upon the start of recording preparations a scanner motor preparation process is initially executed at S100. In the scanner motor preparation process, driving of the scanner motor 97 (FIG. 2) is started. Control is performed to maintain the scanner motor 97 in a steady state in which the driving is stabilized at a constant speed.

At S110, the main motor preparation process is performed. In the main motor preparation process, the main motor 96 (FIG. 2) is also driven. Additionally, control is performed to maintain the main motor 96 in a steady state in which the driving is stabilized at a constant speed. Subsequently, at S120, a voltage is applied to the charging devices 26 of each process cartridge 21. At S130, the scanning processing is started in each process cartridge 21 by a separate thread.

The scanning processing will now be described with reference to FIG. 11.

In the scanning processing, accompanying the start instruction at S130, forced irradiation of a laser beam is initially executed by the scanner unit 20 in S310. Upon detection of the laser beam by an unshown sensor, the process proceeds with 'Yes' at S320 and the laser beam is stopped at S330. When the laser beam is detected at S320, the rotational state of the polygon mirror 22 (FIG. 1) is determined. Thereafter, accurate control can be carried out that takes into consideration the rotation angle of the polygon mirror 22.

Subsequently, at S340, a counter is reset for confirming a horizontal position. In S350, a check is performed next to ascertain whether or not the horizontal position at the current irradiation position is outside of the recording range, based on the value of the counter. If the horizontal position is outside of the recording range, the counter is incremented at S360. The processing of S350 and S360 is repeated until the horizontal position falls within the recording range.

When the horizontal position has entered into the recording range, the process proceeds with 'No' at S350 and the laser beam irradiation processing is performed in response to output data (i.e., image data) (S370). While the horizontal position is within the recording range the process proceeds with 'No' at S380, the counter is incremented at S390, and the processing of S370 is repeated. The processing of S380 and S390 is repeated until the horizontal position falls outside of the recording range. When the horizontal position is outside of a recordable range, the process proceeds with 'Yes' at S380 and returns to S310.

In this connection, since output data has not been sent at the start of recording preparations, the processing of S370 to S390 is performed in a state in which there is no output data.

Returning to FIG. 10, after starting the scanning by a separate thread in S130, the timer is reset at S140. In this illustrative aspect, after the forced irradiation of the initial laser beam for synchronization is completed and after a time T11 has elapsed, the developing roller 27Y is moved to a developing position to cause the developing roller 27Y to press into contact with the photosensitive drum 25Y.

More specifically, according to this exemplary aspect and as illustrated in S310 to S330, at the start of scanning processing forced irradiation of a laser beam for synchronization is performed and the rotational timing of a polygon mirror is determined by detecting that laser beam. However, in the processing of S150 and S160, the position of the developing roller 27Y is changed to a developing position after an electrostatic latent image based on a laser beam for timing detection, which is emitted from the scanner unit 20, passes a position facing the developing roller 27Y. Accordingly, it is possible to effectively prevent consumption of developer by an electrostatic latent image based upon a laser beam for timing detection.

In S160, the driving is started of the motor 120Y, which is provided for pressing the developing roller 27Y into contact with the photosensitive drum 25Y and for separating the developing roller 27Y there from. The driving is continued until the developing roller 27Y reaches a developing position (i.e., contact position). When the developing roller 27Y reaches the developing position, driving of the motor 120Y is stopped. Although only the process for the motor 120Y, which corresponds to the developing roller 27Y, is described here, a similar process is performed for all of the developing rollers 27, such that positional control is independently performed for each developing roller 27.

After the developing roller 27Y contacts the photosensitive drum 25Y, the timer is reset at S170 to count the amount of time after the developing roller 27Y has moved to the developing position. After the developing roller 27Y has moved to the developing position, the developing roller 27M is moved to a developing position (i.e. pressed into contact with the photosensitive drum 25M as shown in FIG. 7A) at S190 at a time period for which a time T2 has elapsed and the process proceeds with 'yes' at S180. As shown in FIG. 7C, this time T2 is set so that the distance between the first corresponding portion Q1 and the second corresponding portion Q2 is less than D2.

Further, when a time T3 has elapsed, the process proceeds with 'Yes' at S200 to move the developing roller 27C to a developing position (i.e., to press the developing roller 27C into contact with the photosensitive drum 25C) at S210. The time T3 is set so that the second corresponding portion Q2 and the third corresponding portion Q3 are the same (see FIG. 8B).

Subsequently, when a time T4 has elapsed, the process proceeds with 'Yes' at S220 to move the developing roller 27K to a developing position (i.e., to press the developing roller 27K into contact with the photosensitive drum 25K)at S230. The time T4 is set so that the third corresponding portion Q4 is the same as the second corresponding portion Q2 and the third corresponding portion Q3 (see FIG. 9B).

Thereafter, at a timing at which a time T5 has elapsed, the process proceeds with 'Yes' at S240, and the cleaning roller 47 is pressed into contact with the conveying belt 38 at S250. Additionally, at a timing at which a time T6 has elapsed, the process proceeds with 'Yes' at S260, and the cleaning roller 47 is separated from the conveying belt 38 at S270. The time T5 is set to be shorter than a time at which the second corresponding portion Q2 and the third corresponding portions Q3 and Q4 arrive at the contact position A5 (see FIG. 4), at which point the cleaning roller 47 comes into contact with the conveying belt 38. Further, the time T6 is set to be longer than a time at which the first corresponding portion Q1 arrives at the contact position A5. According to this configuration, it is possible to effectively prevent the deterioration of components by not allowing the cleaning roller 47 to continuously contact the conveying belt 38. In addition, this configuration effectively cleans all debris, even when toner debris (contamination) occurs in the first corresponding portion Q1, the second corresponding portion Q2, and the third corresponding portions Q3 and Q4.

The recording preparation thus ends. Image formation based on image data is then performed when the recording preparation ends. Until the end of the image formation, each developing roller 27 remains continuously in contact with each photosensitive drum 25. Upon completion of the image formation, each developing roller 27 again moves away from each photosensitive drum 25.

The above described times T11, T2, T3, T4, T5, and T6, will now be described through the use of mathematical formulas, with reference to FIG. 4.

In the following formulas, "R" represents the radius of the photosensitive drum 25, and "D11" represents the distance from the laser beam irradiation position to a position facing (opposing) the developing roller 27. Further, "W" represents the angular velocity of the photosensitive drum 25, and "V" represents the moving velocity of the belt.

Additionally, "D2" represents the distance from a contact position A1, at which point the photosensitive drum 25Y contacts the conveying belt 38, to a contact position A2, at which the photosensitive drum 25M contacts the conveying belt 38. "D3" represents the distance from the contact position A1 to a contact position A3, at which point the photosensitive drum 25C contacts and the conveying belt 38. "D4" represents the distance from the contact position A1 to a contact position A4, at which point the photosensitive drum 25K contacts the conveying belt 38. "D5" represents the distance along the conveying belt 38 from the contact position A1 to a contact position A5, at which point the cleaning roller 47 contacts the conveying belt 38.

"D12" represents the distance from a contact position produced by the developing roller 27K to the contact position A4 on the photosensitive drum 25K. This contact position is a permanent fixed position within the image forming apparatus.

Further, Δ1, Δ2, Δ3, Δ4, Δ5, and Δ6, represent setting values at each position shown in FIG. 4.

Δ1 is the movement amount by which an electrostatic latent image that is generated by forced irradiation of the initial laser beam, in accordance with the T11 setting, moves from a contact position produced by the developing roller 27Y on the photosensitive drum 25Y. This contact position is a permanent fixed position within the image forming apparatus. Δ2 is the distance between the first corresponding portion Q1 and the second corresponding portion Q2. Δ3 is the distance between the third corresponding portion Q3 and the first corresponding portion Q1. Δ4 is the distance between the third corresponding portion Q4 and the first corresponding portion Q1.

Δ5 is the distance between an assumed debris position that is furthest downstream (in this illustrative aspect, the position of the second corresponding portion Q2 and third corresponding portions Q3 and Q4) when the cleaning roller 47 contacts the conveyor belt 38, and the contact position A5. A6 is the distance between the contact position A5 and an upstream debris position when the cleaning roller 47 moves away from the conveyor belt 38 after an assumed debris position that is furthest upstream (in this aspect, the position of the first corresponding portion Q1) has passed the contact position A5.

Further, MAX (Δ2, Δ3, Δ4) represents the maximum value among Δ2, Δ3, and Δ4.

$$T11=(D11+\Delta 1)/(R\cdot W)$$

$$T2=(D2-\Delta 2)/V$$

$$T3=(D3-\Delta 3)/V$$

$$T4=(D4-\Delta 4)/V$$

$$T5=D12/(R\cdot W)+(D5-\mathrm{MAX}(\Delta 2,\Delta 3,\Delta 4)-\Delta 5)/V$$

$$T6=D12/(R\cdot W)+(D5+\Delta 6)/V \qquad \text{[Formula 1]}$$

At this time, in order for the first corresponding portion Q1 to be the portion that is furthest upstream, as in the present exemplary structure, it is sufficient that settings be made to satisfy the following conditions.

Expression 1 $D11/(R\cdot W)\leqq T11$

Expression 2 $0<T2\leqq D2/V$

Expression 3 $0<T3\leqq D3/V$

Expression 4 $0<T4\leqq D4/V$ [Formula 2]

To make T5 shorter than a time at which the second corresponding portion Q2 and third corresponding portions Q3 and Q4 arrive at the contact position A5 of the cleaning roller 47 as described above, it is sufficient to set T5 as follows.

$$T5<D12/(R\cdot W)+D5/V-\mathrm{MAX}(\Delta 2,\Delta 3,\Delta 4)/V \qquad \text{[Formula 3]}$$

Further, to make T6 longer than a time at which the first corresponding portion Q1 arrives at the contact position A5 of the cleaning roller 47 as described above, it is sufficient to set T6 as follows.

$$D12/(R\cdot W)+D5/V<T6 \qquad \text{[Formula 4]}$$

By satisfying formula 5 below in addition to formulas 1 to 4, it is possible to realize a more preferable system that can perform cleaning appropriately.

$$D12/(R\cdot W)+D4/V-\mathrm{MAX}(\Delta 2,\Delta 3,\Delta 4)/V\leqq T5 \qquad \text{[Formula 5]}$$

According to formula 5, T5 is set to a time that is greater than or equal to a time at which the debris that is furthest downstream arrives at the contact position A4. More specifically, there is no hindrance to cleaning regardless of how small T5 is, it is not necessary to reduce T5 to the extent that it does not satisfy this formula. However, by doing so, the contact time of the cleaning roller 47 can be shortened while maintaining cleaning performance.

<Other Illustrative Aspects>

The present invention is not limited to the aspects described by the foregoing descriptions and drawings. For example, the following exemplary structures are also included within the technical scope of the present invention. Various changes and modifications other than those described below may be made therein without departing from the spirit or subject matter of the invention.

(1) The common image bearing member is not limited to a conveying belt as described in the previous illustrative aspect as long as it is a member that can carry the toner of a plurality of colors emanating from each developing roller 27. The common image bearing member may be an intermediate transfer belt, a photosensitive member, or the like.

(2) Although in the previous aspect a photosensitive drum 25 is provided for each developing roller 27, a configuration may be adopted in which a plurality of developing rollers are disposed facing a single photosensitive drum. In this case, the photosensitive member corresponds to a common image bearing member. In addition, the first position and second position are the same as the first corresponding portion and second corresponding portion.

(3) Although in the present exemplary aspect the other developing rollers 27 were assumed to be two developing rollers, one developing roller or three or more developing rollers may be employed as the other developing rollers 27.

(4) In the above described aspect a configuration was adopted whereby $\Delta 2=\Delta 3=\Delta 4$, and $\Delta 2$, $\Delta 3$, and $\Delta 4$, are set so as not to become 0, the second corresponding portion Q2 and the third corresponding portions Q3 and Q4 were made to be the same, and control was performed so that the first corresponding portion Q1 was further on the upstream side than those portions. However, control may also be performed so that the first corresponding portion Q1, the second corresponding portion Q2, and the third corresponding portions Q3 are all at the same position on the conveying belt 38. It is thus possible to make the area on the conveying belt 38 that is affected by all the developing rollers 27 extremely narrow. In this case, timing control may be performed for each of the developing rollers 27 so that $\Delta 2$, $\Delta 3$ and $\Delta 4$ are 0, as shown in FIG. 4.

(5) In the above described illustrative aspect an example was described in which the first corresponding portion Q1 is the furthest upstream on the conveying belt 38. However, any one of the first corresponding portion Q1, the second corresponding portion Q2, and the third corresponding portions Q3 and Q4, may be the furthest upstream. Additionally, the order and positions of the first corresponding portion Q1, the second corresponding portion Q2, and the third corresponding portions Q3 and Q4, are not limited to the above described example.

(6) The above aspect described one example of the sequence of the developing rollers 27K, 27C, 27M, and 27Y. However, the concept of the present invention can be applied regardless of the order in which the developing rollers are disposed. For example, a configuration may be adopted in which the developing roller for black is disposed furthest upstream, the developing roller for cyan is disposed at the second position from the upstream side, and the developing rollers for magenta and yellow are respectively disposed downstream thereof. In this case, the developing roller for black is first developing device, the developing roller for cyan is second developing device, and the developing roller for magenta and the developing roller for yellow are other developing devices.

What is claimed is:

1. An image forming apparatus, comprising:

a plurality of photosensitive members;

wherein the plurality of photosensitive members comprises a first photosensitive member and a second photosensitive member;

a corresponding plurality of developing devices;

wherein each of the plurality of developing devices is disposed proximate to a perimeter of a corresponding photosensitive member;

wherein the plurality of developing devices comprises a first developing device and a second developing device;

a plurality of position changing devices corresponding to the plurality of developing devices;

wherein each of the plurality of position changing devices causes a corresponding developing device to change positions between a developing position adjacent to the photosensitive member and a separated position apart from the photosensitive member;

wherein developer from each of the plurality of developing devices is transferable to a common image bearing member opposing the plurality of photosensitive members;

a first position established when a position on the first photosensitive member opposes the first developing device when the first developing device has changed to the developing position;

a second position established when a position on the second photosensitive member opposes the second developing device when the second developing device has changed to the developing position;

a first corresponding portion on the common image bearing member established when a portion of the common image bearing member opposes the first position;

a second corresponding portion on the common image bearing member established when a portion of the common image bearing member opposes the second position;

a control device for controlling a timing of the plurality of position changing devices;

wherein the timing for changing a position of the first developing device and a position of the second developing device is provided such that a distance between the first corresponding portion and the second corresponding portion is less than a reference distance between the first corresponding portion and the second corresponding portion established when the first developing device and the second developing device simultaneously change to the developing positions.

2. The image forming apparatus according to claim 1, further comprising:

a cleaning device comprising a contact component configured to contact and separate from the common image bearing member;

wherein the control device controls a contact timing of the contact component.

3. The image forming apparatus according to claim 2 wherein the contact timing for the contact component causes the contact component to contact the common image forming member during a portion of the common image forming member that includes the first corresponding portion and the second corresponding portion.

4. The image forming apparatus according to claim 1, wherein the first developing device is disposed further upstream with respect to a sheet conveying direction than the second developing device; and wherein the control device controls the first position changing device and the second position changing device so that the first corresponding portion is further upstream on the common image bearing member than the second corresponding portion.

5. The image forming apparatus according to claim 1, wherein the first developing device is disposed further upstream relative to a sheet conveying direction than the second developing device; and wherein the control device causes the first position changing device to change position of the first developing device to the developing position prior to the second changing device changing the position of the second developing device to the developing position.

6. The image forming apparatus according to claim 1, wherein the plurality of developing devices comprises at least one other developing device;

wherein a third position is established when a position on a corresponding one of the plurality of photosensitive members opposes one of the at least one other developing devices when the one of the at least one other developing devices changes position to the developing position;

wherein a third corresponding portion is established when a portion on the common image bearing member corresponds to the third position; and wherein the control device controls the plurality of position changing devices so that the first corresponding portion, the second corresponding portion, and the third corresponding portion are at the same position on the common image bearing member.

7. The image forming apparatus according to claim 6 wherein the at least one other developing device comprises two developing devices.

8. The image forming apparatus according to claim 1, wherein the plurality of developing devices comprises at least one other developing device;

wherein the first developing device is disposed furthest upstream relative to a sheet conveying direction among the plurality of developing devices;

wherein a third position is established when a position on the corresponding one of the plurality of photosensitive members opposes one of the at least one other developing devices when the one of the at least one other developing devices changes position to the developing position;

wherein a third corresponding portion is established when a portion on the common image bearing member corresponds to the third position;

wherein the control device controls the plurality of position changing devices such that the second corresponding portion and the third corresponding portion are at the same position downstream of the first corresponding portion on the common image bearing member.

9. The image forming apparatus according to claim 1, wherein the control device causes the plurality of position changing devices to change positions of the corresponding plurality of developing devices to the developing position after a timing detection electrostatic latent image, emitted from a laser beam irradiating device, passes a position opposing the plurality of developing devices.

10. An image forming apparatus, comprising:

a photosensitive member;

a plurality of developing devices;

wherein the plurality of developing devices is disposed proximate to a perimeter of the photosensitive member;

wherein the plurality of developing devices comprises a first developing device and a second developing device;

a plurality of position changing devices corresponding to the plurality of developing devices;

wherein each of the plurality of position changing devices causes a corresponding developing device to change positions between a developing position adjacent to the photosensitive member and a separated position apart from the photosensitive member;

wherein developer from each of the plurality of developing devices is transferable to a common image bearing member comprising the photosensitive member;

a first position established when a position on the photosensitive member opposes the first developing device when the first developing device has changed to the developing position;

a second position established when a position on the photosensitive member opposes the second developing device when the second developing device has changed to the developing position;

a first corresponding portion on the common image bearing member corresponding to the first position;

a second corresponding portion on the common image bearing member corresponding to the second position;

a control device for controlling a timing of the plurality of position changing devices;

wherein the timing for changing a position of the first developing device and a position of the second developing device is provided such that a distance between the first corresponding portion and the second corresponding portion is less than a reference distance between the first corresponding portion and the second corresponding portion established when the first developing device and the second developing device simultaneously change to the developing positions.

11. The image forming apparatus according to claim 10, further comprising:

a cleaning device comprising a contact component configured to contact and separate from the common image bearing member;

wherein the control device controls a contact timing of the contact component.

12. The image forming apparatus according to claim 11 wherein the contact timing for the contact component causes the contact component to contact the common image forming member during a portion of the common image forming member that includes the first corresponding portion and the second corresponding portion.

13. The image forming apparatus according to claim 10, wherein the first developing device is disposed further upstream with respect to a sheet conveying direction than the second developing device; and wherein the control device controls the first position changing device and the second position changing device so that the first corresponding portion is further upstream on the common image bearing member than the second corresponding portion.

14. The image forming apparatus according to claim 10, wherein the first developing device is disposed further upstream relative to a sheet conveying direction than the second developing device; and wherein the control device causes the first position changing device to change position of the first developing device to the developing position prior to the second changing device changing the position of the second developing device to the developing position.

15. The image forming apparatus according to claim 10, wherein the plurality of developing devices comprises at least one other developing device;

wherein a third position is established when a position on the photosensitive members opposes one of the at least one other developing devices when the one of the at least one other developing devices changes position to the developing position;

wherein a third corresponding portion on the common image bearing member corresponds to the third position;

wherein the control device controls the plurality of position changing devices so that the first corresponding portion, the second corresponding portion, and the third corresponding portion are at the same position on the common image bearing member.

16. The image forming apparatus according to claim 15 wherein the at least one other developing device comprises two developing devices.

17. The image forming apparatus according to claim 10, wherein the plurality of developing devices comprises at least one other developing device;

wherein the first developing device is disposed furthest upstream relative to a sheet conveying direction among the plurality of developing devices;

wherein a third position is established when a position on the photosensitive members opposes one of the at least one other developing devices when the one of the at least one other developing devices changes position to the developing position;

wherein a third corresponding portion on the common image bearing member corresponds to the third position;

wherein the control device controls the plurality of position changing devices such that the second corresponding portion and the third corresponding portion are at the same position downstream of the first corresponding portion on the common image bearing member.

18. The image forming apparatus according to claim 10, wherein the control device causes the plurality of position changing devices to change positions of the corresponding plurality of developing devices to the developing position after a timing detection electrostatic latent image, emitted from a laser beam irradiating device, passes a position opposing the plurality of developing devices.

19. An image forming apparatus, comprising:

a photosensitive member;

developing devices disposed proximate to a perimeter of the photosensitive member; and position changing devices causing each of the developing devices to change position between a developing position adjacent to the photosensitive member and a separated position separated from the photosensitive member;

wherein the position changing devices are configured to cause the developing devices to change positions to the developing position after a timing detection electrostatic latent image emitted from a laser beam irradiating device passes a position opposing the developing devices.

* * * * *